US006100514A

United States Patent [19]

Davis

[11] Patent Number: 6,100,514

[45] Date of Patent: Aug. 8, 2000

[54] COVER FOR MICROWAVABLE CONTAINERS

[76] Inventor: Linda J. Davis, 1238 Beams La. Box 171, Camden, S.C. 29020

[21] Appl. No.: 09/306,856

[22] Filed: May 7, 1999

Related U.S. Application Data

[60] Provisional application No. 60/109,159, Nov. 20, 1998.

[51] Int. Cl.[7] ..... H05B 6/80

[52] U.S. Cl. ..... 219/735; 219/734; 99/DIG. 14; 150/154; 426/118; 426/243

[58] Field of Search ..... 219/725, 734, 219/735; 150/154, 165, 901; 99/DIG. 14; 426/241, 243, 118

[56] References Cited

U.S. PATENT DOCUMENTS

| | | | |
|---|---|---|---|
| D. 394,604 | 5/1998 | Cammack . | |
| 4,282,279 | 8/1981 | Strickland | 150/154 |
| 4,721,140 | 1/1988 | Coker | 219/734 |
| 4,982,064 | 1/1991 | Hartman et al. . | |
| 5,050,999 | 9/1991 | Van Loon, III . | |
| 5,052,369 | 10/1991 | Johnson | 219/734 |
| 5,126,520 | 6/1992 | Nottingham et al. | 219/735 |
| 5,132,151 | 7/1992 | Graney | 219/735 |
| 5,235,149 | 8/1993 | Boehrer | 219/734 |
| 5,260,536 | 11/1993 | Peery | 219/725 |
| 5,344,661 | 9/1994 | Mendenhall et al. . | |
| 5,346,312 | 9/1994 | Mabry et al. . | |
| 5,412,187 | 5/1995 | Walters et al. . | |

*Primary Examiner*—Philip H. Leung
*Attorney, Agent, or Firm*—B. Craig Killough

[57] ABSTRACT

A cover for microwavable containers is formed of a composite of textile materials which enhance microwave cooking. One layer provides insulation to hold heat within the microwavable container, while another retards splattering. The device allows steam ventilation from the container without the requirement of lifting a corner of the container, or otherwise taking steps to provide ventilation. The cover is machine washable. The cover has an elastic perimeter which allows the cover to be placed over the container, with the elastic holding the cover in place against the container, and allows the cover to fit a range of variously sized and shaped microwavable containers.

15 Claims, 1 Drawing Sheet

COVER FOR MICROWAVABLE CONTAINERS

REFERENCE TO RELATED APPLICATIONS

This application claims priority of provisional application Ser. No. 60/109,159 filed Nov. 20, 1998.

FIELD OF THE INVENTION

This invention relates to covers for containers generally, and is specifically directed to a cover for microwavable food containers.

BACKGROUND OF THE INVENTION

Containers for storing and cooking food come in various shapes and sizes. Such containers usually come with matching lids which are sized to cover and seal the container. With the advent of microwave ovens, food may be placed in a microwavable container for cooking in the microwave oven, and left over food may be stored in the same container in a refrigerator. The food may be cooked in a microwave, placed in a refrigerator for storage, and subsequently removed from the refrigerator and placed in the microwave for reheating. Most containers which are formed of materials other than metal may be used in conjunction with a microwave oven.

The myriad of sizes and shapes of containers causes a problem. Each variously sized container has its own lid or cover, which also has a unique size and shape and which matches the container. These covers are particularly useful for microwave cooking, in that they keep the food from splattering as it is heated in the microwave oven. The nature of microwave ovens is such that, as the water in the food forms steam, the steam forces the food from the container. A substantial mess is created in the microwave oven if the container is not covered. However, because of the wide range of lid sizes for containers, it is often difficult to find the matching lid for a particular container. Many containers are approximately the same size, but if the lid does not fit tightly over the container, it cannot be used. Attempting to keep up with, and match container lids with containers is a problem.

Microwave instructions state that it is necessary to lift a corner of the cover, or to otherwise vent the cover to avoid problems associated with steam pressure building within the container as the food is heated.

There is a need for a lid which will fit a wide range of container sizes and shapes. The lid should also facilitate microwave cooking and preferably, enhance microwave cooking.

SUMMARY OF THE INVENTION

The present invention is a cover for containers. The cover is particularly well suited for use with microwavable containers. The cover is formed of a composite of materials which enhance microwave cooking. The cover has an elastic perimeter which allows the cover to be placed over the container, with the elastic holding the cover in place against the container. The use of the elastic material means that a single cover will fit a range of variously sized and shaped microwavable containers.

A composite of materials used to construct the present invention provides insulation to hold heat within the microwavable container, while also incorporating a material which retards splattering. The device is constructed to allow steam ventilation from the container, while retarding splattering, without the requirement of lifting a corner of the container, or otherwise taking steps to provide ventilation.

The resulting cover is machine washable. When the cover is used to cover plates or bowls having metallic trim, the cover retards or prevents problems associated with the presence of metals within microwave ovens. The cover may be formed to function as a bag which surrounds a container, or alternatively, which surrounds the food to be cooked without the use of a container.

DETAILED DESCRIPTION OF THE PREFERRED EMBODIMENT

Figure 1:
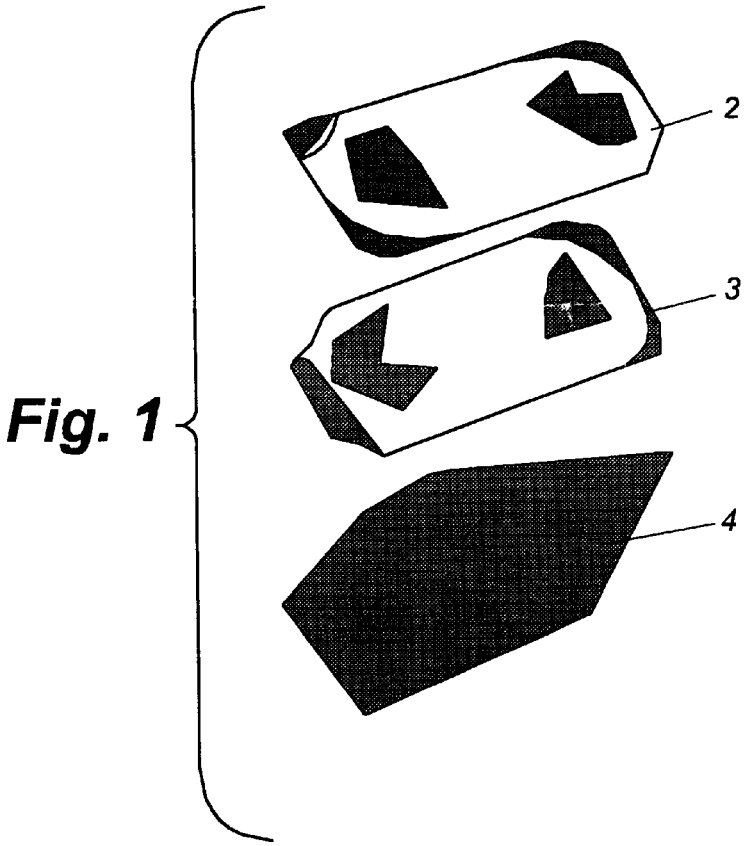
FIG. 1 is an exploded view of the cover.
Figure 2:
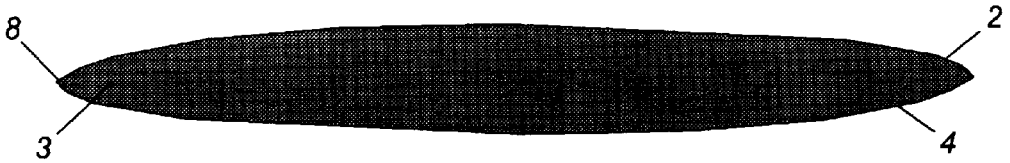
FIG. 2 is a sectioned view of the cover.

Referring now to the drawing figures, FIG. 1 shows the elements of the container cover of the preferred embodiment. The cover as shown is formed of multiple layers of textile materials.

In the preferred embodiment, the cover is formed of a layer 3 of a textile material which is commonly known as cheese cloth. Cheese cloth of 14×8 gauge may be used. Cheese cloth is normally made of cotton, has insulating properties, and is easily washable. The gauge of the cheese cloth indicates an absorbent and insulative material which is formed in a grid, with spacing between the fibers that allows steam to escape.

The lower layer 4 which is adjacent to the container is non porous mesh, which prevents splattering, and prevents liquids from soaking through to the top layers of the cover, which are more absorbent, in an unsanitary fashion. The lower layer may be formed of a polymer fiber which is preferred to be nylon. The individual nylon fibers are non-porous, but a nylon mesh is used. The nylon mesh prevents splattering and absorbency of food into the fibers, since the individual fibers are non-porous. The use of a mesh provides ventilation, so that it is not necessary to otherwise vent the container. Virtually all microwave container instructions state that it is necessary to lift a corner of the cover, or to otherwise vent the cover to avoid problems associated with steam pressure building within the container as the food is heated. Such ventilation is not necessary since the device is formed of materials which allow steam to escape through the cover itself.

An additional layer of textile material may be used to form a top layer 2 and is over the cheese cloth. A mesh type textile material which is commonly known as embroidery backing may be used. Embroidery backing has an insulative quality which holds heat within the container, but again has pores or openings which allow steam to escape.

In some applications it may be desirable to add an additional intermediate layer, or to replace the nylon mesh with a non-porous, microwavable material, such as a plastic that will withstand microwave energy and the heat which is generated within the dish. However, in general, as stated above, due to steam pressure building within the container, this layer will not be commonly used, except in specialty applications.

Near the perimeter of the cover, elastic is sewn or otherwise affixed about the perimeter of the container. For example, ¼ inch elastic may be sewn in to the cover at or near the perimeter of the cover. This elastic allows the cover to be firmly affixed to the container. The stretchable nature of the elastic allows the container to be used with containers of relatively wide range of sizes. It is not necessary to have a cover which is matched specifically to a size and shape of a container. Other attachment means could be used. For example, a drawstring could be used to secure the cover to the container, or one or more snaps could be used to reduce size of the opening, thereby securing the cover to the container.

The covers can be made in a range of sizes. However, a cover sized in ranges such as small, medium and large, will allow their use with literally hundreds of containers of varying sizes and shapes, due to the elastic fitting of the cover over the container.

The textile nature of the device allows it to be easily machine washed.

It is no longer necessary to preserve and locate lids for each particular container which is used within a kitchen. A person can purchase the present invention in small, medium and large sizes, and purchase two or three of each size so that covers are available when others are being washed or stored in the refrigerator. In general, fewer covers will be maintained in inventory, and the frustration of trying to maintain a locate a particular cover for each particular container is eliminated.

The cover may be formed in the shape of a bag. The entire container may be placed into the bag. The cover is formed in layers of materials as described above to form a composite, but formed in a shape which surrounds the container. The bag is preferred to be large enough for easy ingress and egress of the container, and to allow the bag to be used with containers of various sizes. The opening of the bag is relative large to allow ingress and egress of the container. Closure means is provided which may be a drawstring, elastic, snaps, hook and loop material, or other know closure means.

This device also facilitates microwave cooking by retaining heat, and preventing splattering, without the necessity of ventilating the container during cooking, and is therefore, superior to microwave cooking over lids which are commonly supplied with microwavable containers.

What is claimed is:

1. A cover for a food container for use in microwave cooking, comprising:

a. a top insulative layer formed of material having a multiplicity of pores formed therein; and b. a mesh layer formed of a non porous fiber, said mesh layer having a multiplicity of pores therein, and being of generally the same size and shape as said top insulative layer, and wherein said mesh layer is connected to said top insulative layer to form said cover in the shape of an enclosure for a food container for use in microwave cooking;

wherein, in use, said cover for a food container for use in microwave cooking so formed has sufficient pores to allow steam pressure to escape from said cover.

2. A cover for a food container for use in microwave cooking as described in claim 1, wherein said top insulative layer is formed of a woven textile material; and said mesh layer is formed of nylon.

3. A cover for a food container for use in microwave cooking as described in claim 2, wherein said top insulative layer formed of a woven textile material comprises cotton.

4. A cover for a food container for use in microwave cooking as described in claim 3, wherein the enclosure is in the shape of a bag.

5. A cover for a food container for use in microwave cooking as described in claim 4, further comprising a closure which surrounds a perimeter of an opening of the enclosure.

6. A cover for a food container for use in microwave cooking as described in claim 3, further comprising a closure which surrounds a perimeter of an opening of the enclosure.

7. A cover for a food container for use in microwave cooking as described in claim 6, wherein said closure comprises a strand of elastic material.

8. A cover for a food container for use in microwave cooking as described in claim 2, wherein the enclosure is in the shape of a bag.

9. A cover for a food container for use in microwave cooking as described in claim 8, further comprising a closure which surrounds a perimeter of an opening of the enclosure.

10. A cover for a food container for use in microwave cooking as described in claim 2, further comprising a closure which surrounds a perimeter of an opening of the enclosure.

11. A cover for a food container for use in microwave cooking as described in claim 10, wherein said closure comprises a strand of elastic material.

12. A cover for a food container for use in microwave cooking as described in claim 1, wherein the enclosure is in the shape of a bag.

13. A cover for a food container for use in microwave cooking as described in claim 12, further comprising a closure which surrounds a perimeter of an opening of the enclosure.

14. A cover for a food container for use in microwave cooking as described in claim 1, further comprising a closure which surrounds a perimeter of an opening of the enclosure.

15. A cover for a food container for use in microwave cooking as described in claim 14, wherein said closure comprises a strand of elastic material.

* * * * *